US010883061B2

(12) United States Patent
Goldsmith et al.

(10) Patent No.: US 10,883,061 B2
(45) Date of Patent: Jan. 5, 2021

(54) AVIATION GASOLINE COMPOSITIONS

(71) Applicant: Calumet Specialty Products Partners, L.P., Indianapolis, IN (US)

(72) Inventors: Anne B. Goldsmith, Zionsville, IN (US); Edward Juno, Marshall, TX (US); John C. Burger, Long Beach, CA (US); Indresh Mathur, Sugar Land, TX (US)

(73) Assignee: Calumet Specialty Products Partners, L.P., Indianapolis, IN (US)

( * ) Notice: Subject to any disclaimer, the term of this patent is extended or adjusted under 35 U.S.C. 154(b) by 0 days.

(21) Appl. No.: 16/409,276

(22) Filed: May 10, 2019

(65) Prior Publication Data

US 2019/0345403 A1 Nov. 14, 2019

Related U.S. Application Data

(60) Provisional application No. 62/669,706, filed on May 10, 2018.

(51) Int. Cl.

| | |
|---|---|
| ***C10L 10/10*** | (2006.01) |
| ***C10L 1/04*** | (2006.01) |
| ***C10L 1/182*** | (2006.01) |
| ***C10L 1/223*** | (2006.01) |

(52) U.S. Cl.

CPC ..... *C10L 10/10* (2013.01); *C10L 1/04* (2013.01); *C10L 1/1824* (2013.01); *C10L 1/223* (2013.01); *C10L 2270/04* (2013.01); *C10L 2300/20* (2013.01)

(58) Field of Classification Search

CPC ..... C10L 10/10; C10L 1/04; C10L 1/1824; C10L 1/223; C10L 2270/04; C10L 2300/20

See application file for complete search history.

(56) References Cited

U.S. PATENT DOCUMENTS

| | | | | |
|---|---|---|---|---|
| 8,840,689 | B2 | 9/2014 | Mathur et al. | |
| 9,127,225 | B2 * | 9/2015 | Shea | C10L 1/10 |
| 2002/0045785 | A1 * | 4/2002 | Bazzani | C10L 1/023 585/14 |
| 2003/0040650 | A1 * | 2/2003 | Butler | C10L 1/06 585/14 |
| 2010/0263262 | A1 * | 10/2010 | Gaughan | C10L 1/143 44/347 |

* cited by examiner

*Primary Examiner* — Cephia D Toomer

(74) *Attorney, Agent, or Firm* — Barnes & Thornburg LLP

(57) ABSTRACT

The present disclosure provides base aviation gasoline formulations. In addition, the present disclosure provides formulations in which one or more additives can optionally be added to the base aviation gasoline formulation to produce a finished aviation gasoline formulation.

20 Claims, No Drawings

AVIATION GASOLINE COMPOSITIONS

CROSS-REFERENCE TO RELATED APPLICATIONS

This application claims the benefit under 35 USC § 119(e) of U.S. Provisional Application Ser. No. 62/669,706, filed on May 10, 2018, the entire disclosure of which is incorporated herein by reference.

TECHNICAL FIELD

The invention relates to base aviation gasoline formulations. The invention also includes formulations in which one or more additives can optionally be added to the base aviation gasoline formulation to produce a finished aviation gasoline formulation.

BACKGROUND AND SUMMARY OF THE INVENTION

Formulations of aviation gasoline that do not require the addition of lead are highly desired by the Federal Aviation Administration and around the world. Current aviation fuels include lead in order to achieve the necessary octane levels for airplanes to achieve flight. According to the current state of the art, lead-containing additives must be added to a "base" aviation fuel blend in order to increase octane values (e.g., Motor Octane Number (MON)) of aviation gasoline. Lead is known to be detrimental to the environment and has been banned in motor fuels since the 1970s. Current aviation gasoline formulations represent the last major source of man-added lead into the environment.

A fuel that does not include harmful lead-containing additives, yet is sufficient for use in the aviation industry, is highly desirable. Ideally, such a fuel could be utilized as a "drop-in" to power existing airplane engines without modifications to the engines themselves.

Therefore, there exists a need for new formulations for use in the aviation industry that are sufficiently free of lead-containing additives. Accordingly, the present disclosure provides novel formulations of aviation gasoline that are beneficial and have numerous advantages to current formulations in the art.

The present disclosure provides base aviation gasoline formulations. In addition, the present disclosure provides formulations in which one or more additives can optionally be added to the base aviation gasoline formulation to produce a finished aviation gasoline formulation.

The formulations of aviation gasoline according to the present disclosure provide several advantages compared to other formulations known in the art. First, the disclosed formulations do not require lead-containing additives in order to achieve octane ratings sufficient for fuel standards in the airline industry. For example, the disclosed formulations can be produced with conventional technologies but meet the current ASTM D910 standards without the addition of lead. It is contemplated that a "new" ASTM specification standard without the use of lead will be identified (herein referred to as an ASTM D910-like specification) and that the disclosed formulations can be produced to meet the ASTM D910-like specification.

Second, the disclosed formulations can be produced to meet the ASTM D909 Supercharge Test. In particular, the disclosed formulations can be produced to meet the ASTM D909 Supercharge Test standards of 130 minimum.

Third, the disclosed formulations can provide benefits such as a low density and higher energy content/pound of fuel, both important considerations in the desirability of the fuel. Fourth, the disclosed formulations do not require the addition of hydrocarbon-based aromatics to the formulation and can be produced so that the formulations are substantially free of hydrocarbon-based aromatics in their final form. Hydrocarbon-based aromatics in fuels face increasing scrutiny, as a source of engine carbon deposits, increased environment toxicity due to incomplete engine combustion, higher fuel density and lower energy content, and increased carbon intensity of the fuel, leading to higher $CO_2$ emissions.

The following numbered embodiments are contemplated and are non-limiting:

1. A base aviation gasoline formulation comprising:
   i) dimethylbutane at a concentration between about 10% to about 40%;
   ii) trimethyl pentane at a concentration between about 50% to about 90%; and
   iii) isobutane at a concentration between about 1% to about 5%.
2. A formulation comprising the base aviation gasoline formulation of clause 1 and further comprising one or more additives.
3. The formulation of clause 2, wherein the additive is selected from the group consisting of m-toluidine, methylcyclopentadienyl manganese tricarbonyl (MMT), aniline, ethyl tert-butyl ether (ETBE), a corrosion inhibitor, a lubricity additive, one or more alcohols, and any combination thereof.
4. The formulation of clause 2, wherein the additive comprises m-toluidine.
5. The formulation of clause 2, wherein the additive comprises methylcyclopentadienyl manganese tricarbonyl (MMT).
6. The formulation of clause 2, wherein the additive comprises aniline.
7. The formulation of clause 2, wherein the additive comprises ethyl tert-butyl ether (ETBE).
8. The formulation of clause 2, wherein the additive comprises one or more alcohols.
9. The formulation of clause 8, wherein the one or more alcohols are selected from the group consisting of ethanol, propanol, isopropanol, n-butanol, isobutanol, and any combination thereof.
10. The formulation of clause 8, wherein the alcohol is ethanol.
11. The formulation of clause 8, wherein the alcohol is propanol.
12. The formulation of clause 8, wherein the alcohol is isopropanol.
13. The formulation of clause 8, wherein the alcohol is n-butanol.
14. The formulation of clause 8, wherein the alcohol is isobutanol.
15. The formulation of clause 2, wherein the additives comprise m-toluidine and methylcyclopentadienyl manganese tricarbonyl (MMT).
16. The formulation of clause 2, wherein the additives comprise m-toluidine and isobutanol.
17. The formulation of clause 2, wherein the additive comprises m-toluidine, methylcyclopentadienyl manganese tricarbonyl (MMT), and one or more alcohols.
18. The formulation of clause 17, wherein the one or more alcohols are selected from the group consisting of ethanol, propanol, isopropanol, n-butanol, isobutanol, and any combination thereof.

19. The formulation of clause 17, wherein the alcohol is ethanol.
20. The formulation of clause 17, wherein the alcohol is propanol.
21. The formulation of clause 17, wherein the alcohol is isopropanol.
22. The formulation of clause 17, wherein the alcohol is n-butanol.
23. The formulation of clause 17, wherein the alcohol is isobutanol.
24. The formulation of any of clauses 2 to 23, wherein addition of the one or more additives provides a MON rating to a desired MON level.
25. The formulation of clause 24, wherein the desired MON level is about 99.6.
26. The formulation of clause 24, wherein the desired MON level is less than 99.6 but in compliance with an ASTM D910-like specification (i.e. Specification Relief).
27. The base aviation gasoline formulation of clause 1, wherein the base aviation gasoline formulation is substantially free of hydrocarbon-based aromatics.
28. The base aviation gasoline formulation of clause 1, wherein the base aviation gasoline formulation does not comprise hydrocarbon-based aromatics.
29. The formulation of any of clauses 2 to 26, wherein the formulation is substantially free of hydrocarbon-based aromatics.
30. The formulation of any of clauses 2 to 26, wherein the formulation does not comprise hydrocarbon-based aromatics.
31. A finished aviation gasoline formulation comprising:
i) dimethylbutane at a concentration between about 10% to about 40%;
ii) trimethyl pentane at a concentration between about 50% to about 90%;
iii) isobutane at a concentration between about 1% to about 5%, and
iv) two additives, wherein the two additives comprise a first additive and a second additive.
32. The finished aviation gasoline formulation of clause 31, wherein the first additive is selected from the group consisting of m-toluidine, methylcyclopentadienyl manganese tricarbonyl (MMT), aniline, ethyl tert-butyl ether (ETBE), a corrosion inhibitor, a lubricity additive, one or more alcohols, and any combination thereof.
33. The finished aviation gasoline formulation of clause 31, wherein the first additive is m-toluidine.
34. The finished aviation gasoline formulation of clause 31, wherein the first additive is methylcyclopentadienyl manganese tricarbonyl (MMT).
35. The finished aviation gasoline formulation of clause 31, wherein the first additive is aniline
36. The finished aviation gasoline formulation of clause 31, wherein the first additive is ethyl tert-butyl ether (ETBE).
37. The finished aviation gasoline formulation of any of clauses 31 to 36, wherein the second additive comprises one or more alcohols.
38. The finished aviation gasoline formulation of any of clauses 31 to 36, wherein the second additive is selected from the group consisting of ethanol, propanol, isopropanol, n-butanol, isobutanol, and any combination thereof.
39. The finished aviation gasoline formulation of any of clauses 31 to 36, wherein the second additive is ethanol.
40. The finished aviation gasoline formulation of any of clauses 31 to 36, wherein the second additive is propanol.
41. The finished aviation gasoline formulation of any of clauses 31 to 36, wherein the second additive is isopropanol.
42. The finished aviation gasoline formulation of any of clauses 31 to 36, wherein the second additive is butanol.
43. The finished aviation gasoline formulation of any of clauses 31 to 36, wherein the second additive is isobutanol.
44. The finished aviation gasoline formulation of clause 31, wherein the first additive is m-toluidine and the second additive is isobutanol.
45. The finished aviation gasoline formulation of any of clauses 31 to 44, wherein addition of the additives provides a MON rating to a desired MON level.
46. The finished aviation gasoline formulation of clause 45, wherein the desired MON level is about 99.6.
47. The finished aviation gasoline formulation of clause 45, wherein the desired MON level is less than 99.6 but in compliance with an ASTM D910-like specification (i.e. Specification Relief).
48. The finished aviation gasoline formulation of any of clauses 31 to 47, wherein the finished aviation gasoline formulation is substantially free of hydrocarbon-based aromatics.
49. The finished aviation gasoline formulation of any of clauses 31 to 47, wherein the finished aviation gasoline formulation does not comprise hydrocarbon-based aromatics.

BRIEF DESCRIPTION OF THE DRAWINGS

Various embodiments of the invention are described herein as follows. In one embodiment described herein, a base aviation gasoline formulation is provided wherein the base aviation gasoline formulation comprises i) dimethylbutane at a concentration between about 10% to about 40%; ii) trimethyl pentane at a concentration between about 50% to about 90%; and iii) isobutane at a concentration between about 1% to about 5%. All percentages listed in the present disclosure refer to volume percentages, unless otherwise noted.

In another embodiment, a finished aviation gasoline formulation is provided wherein the finished aviation gasoline formulation comprises i) dimethylbutane at a concentration between about 10% to about 40%; ii) trimethyl pentane at a concentration between about 50% to about 90%; iii) isobutane at a concentration between about 1% to about 5%, and iv) two additives, wherein the two additives comprise a first additive and a second additive.

In the various embodiments, the base aviation gasoline formulation comprises dimethylbutane. Dimethylbutane is well known in the art as an alkane and has the formula $C_6H_{14}$. In particular, the structure of dimethylbutane can comprise either 2,3-dimethylbutane or 2,2-dimethylbutane, each of which are depicted below:

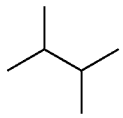

2,3-dimethylbutane

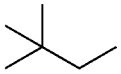

2,2-dimethylbutane

In various embodiments, the dimethylbutane comprises 2,3-dimethylbutane. In other embodiments, the dimethylbutane comprises 2,2-dimethylbutane. In some embodiments, the dimethylbutane comprises 2,3-dimethylbutane and 2,2-dimethylbutane.

In various embodiments, the dimethylbutane consists essentially of 2,3-dimethylbutane. In other embodiments, the dimethylbutane consists essentially of 2,2-dimethylbutane. In some embodiments, the dimethylbutane consists essentially of 2,3-dimethylbutane and 2,2-dimethylbutane.

In various embodiments, the dimethylbutane consists of 2,3-dimethylbutane. In other embodiments, the dimethylbutane consists of 2,2-dimethylbutane. In some embodiments, the dimethylbutane consists of 2,3-dimethylbutane and 2,2-dimethylbutane.

In certain aspects, the dimethylbutane is present in the base aviation gasoline formulation at a concentration between about 10% to about 40%. In some embodiments, the dimethylbutane is present in the base aviation gasoline formulation at a concentration between about 15% to about 35%. In other embodiments, the dimethylbutane is present in the base aviation gasoline formulation at a concentration between about 20% to about 30%.

In certain aspects, the dimethylbutane is present in the base aviation gasoline formulation at a concentration of about 10%. In certain aspects, the dimethylbutane is present in the base aviation gasoline formulation at a concentration of about 15%. In certain aspects, the dimethylbutane is present in the base aviation gasoline formulation at a concentration of about 20%. In certain aspects, the dimethylbutane is present in the base aviation gasoline formulation at a concentration of about 25%. In certain aspects, the dimethylbutane is present in the base aviation gasoline formulation at a concentration of about 30%. In certain aspects, the dimethylbutane is present in the base aviation gasoline formulation at a concentration of about 35%. In certain aspects, the dimethylbutane is present in the base aviation gasoline formulation at a concentration of about 40%.

In the various embodiments, the dimethylbutane can include 2,3-dimethylbutane and/or 2,2-dimethylbutane in any quantity to comprise the stated concentration of dimethylbutane.

In the various embodiments, the base aviation gasoline formulation comprises any of the isomers of trimethyl pentane, individually or in any combination. Trimethyl pentane has the formula $(CH_3)_3CCH_2CH(CH_3)_2$. For instance, the structure of one isomer of trimethyl pentane is as follows:

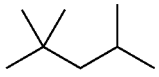

In certain aspects, the trimethyl pentane is present in the base aviation gasoline formulation at a concentration between about 50% to about 90%. In some embodiments, the trimethyl pentane is present in the base aviation gasoline formulation at a concentration between about 60% to about 80%. In other embodiments, the trimethyl pentane is present in the base aviation gasoline formulation at a concentration between about 60% to about 70%. In other embodiments, the trimethyl pentane is present in the base aviation gasoline formulation at a concentration between about 70% to about 80%.

In certain aspects, the trimethyl pentane is present in the base aviation gasoline formulation at a concentration of about 50%. In certain aspects, the trimethyl pentane is present in the base aviation gasoline formulation at a concentration of about 55%. In certain aspects, the trimethyl pentane is present in the base aviation gasoline formulation at a concentration of about 60%. In certain aspects, the trimethyl pentane is present in the base aviation gasoline formulation at a concentration of about 65%. In certain aspects, the trimethyl pentane is present in the base aviation gasoline formulation at a concentration of about 70%. In certain aspects, the trimethyl pentane is present in the base aviation gasoline formulation at a concentration of about 75%. In certain aspects, the trimethyl pentane is present in the base aviation gasoline formulation at a concentration of about 80%. In certain aspects, the trimethyl pentane is present in the base aviation gasoline formulation at a concentration of about 85%. In certain aspects, the trimethyl pentane is present in the base aviation gasoline formulation at a concentration of about 90%.

In certain aspects, the trimethyl pentane is present in the base aviation gasoline formulation at a concentration of about 65%. In certain aspects, the trimethyl pentane is present in the base aviation gasoline formulation at a concentration of about 65.5%. In certain aspects, the trimethyl pentane is present in the base aviation gasoline formulation at a concentration of about 66%. In certain aspects, the trimethyl pentane is present in the base aviation gasoline formulation at a concentration of about 66.5%. In certain aspects, the trimethyl pentane is present in the base aviation gasoline formulation at a concentration of about 67%. In certain aspects, the trimethyl pentane is present in the base aviation gasoline formulation at a concentration of about 67.5%. In certain aspects, the trimethyl pentane is present in the base aviation gasoline formulation at a concentration of about 68%. In certain aspects, the trimethyl pentane is present in the base aviation gasoline formulation at a concentration of about 68.5%. In certain aspects, the trimethyl pentane is present in the base aviation gasoline formulation at a concentration of about 69%. In certain aspects, the trimethyl pentane is present in the base aviation gasoline formulation at a concentration of about 69.5%. In certain aspects, the trimethyl pentane is present in the base aviation gasoline formulation at a concentration of about 70%. In certain aspects, the trimethyl pentane is present in the base aviation gasoline formulation at a concentration of about 70.5%. In certain aspects, the trimethyl pentane is present in the base aviation gasoline formulation at a concentration of about 71%. In certain aspects, the trimethyl pentane is present in the base aviation gasoline formulation at a concentration of about 71.5%. In certain aspects, the trimethyl pentane is present in the base aviation gasoline formulation at a concentration of about 72%. In certain aspects, the trimethyl pentane is present in the base aviation gasoline formulation at a concentration of about 72.5%. In certain aspects, the trimethyl pentane is present in the base aviation gasoline formulation at a concentration of about 73%. In certain aspects, the trimethyl pentane is present in the base aviation gasoline formulation at a concentration of about 73.5%. In certain aspects, the trimethyl pentane is present in the base aviation gasoline formulation at a concentration of about 74%. In certain aspects, the trimethyl pentane is present in the base aviation gasoline formulation at a concentration of about 74.5%. In certain aspects, the trimethyl pentane is present in the base aviation gasoline formulation at a concentration of about 75%. In certain aspects, the trimethyl pentane is present in the base aviation gasoline formulation at a concentration of about 75.5%. In certain aspects, the trimethyl pentane is present in the base aviation gasoline formulation at a concentration of about 76%. In certain aspects, the trimethyl pentane is present in the base aviation gasoline formulation at a concentration of about 76.5%. In certain aspects, the trimethyl pentane is present in the base aviation gasoline formulation at a concentration of about 77%. In certain aspects, the trimethyl pentane is present in the base aviation gasoline formulation at a concentration of about 77.5%. In certain aspects, the trimethyl pentane is present in the base aviation gasoline formulation at a concentration of about 78%. In certain aspects, the trimethyl pentane is present in the base aviation gasoline formulation at a concentration of about 78.5%. In certain aspects, the trimethyl pentane is present in the base aviation gasoline formulation at a concentration of about 79%. In certain aspects, the trimethyl pentane is present in the base aviation gasoline formulation at a concentration of about 79.5%. In certain aspects, the trimethyl pentane is present in the base aviation gasoline formulation at a concentration of about 80%.

In the various embodiments, the base aviation gasoline formulation comprises isobutane. Isobutane, also known as i-butane, 2-methylpropane or methylpropane, has the formula $HC(CH_3)_3$. For instance, the structure of isobutane is as follows:

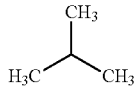

In certain aspects, the isobutane is present in the base aviation gasoline formulation at a concentration between about 1% to about 5%. In some embodiments, the isobutane is present in the base aviation formulation at a concentration between about 2% to about 5%. In some embodiments, the isobutane is present in the base aviation formulation at a concentration between about 3% to about 4%. In some embodiments, the isobutane is present in the base aviation formulation at a concentration between about 2% to about 4%.

In some embodiments, the isobutane is present in the base aviation formulation at a concentration of about 2%. In some embodiments, the isobutane is present in the base aviation formulation at a concentration of about 2.1%. In some embodiments, the isobutane is present in the base aviation formulation at a concentration of about 2.2%. In some embodiments, the isobutane is present in the base aviation formulation at a concentration of about 2.3%. In some embodiments, the isobutane is present in the base aviation formulation at a concentration of about 2.4%. In some embodiments, the isobutane is present in the base aviation formulation at a concentration of about 2.5%. In some embodiments, the isobutane is present in the base aviation formulation at a concentration of about 2.6%. In some embodiments, the isobutane is present in the base aviation formulation at a concentration of about 2.7%. In some embodiments, the isobutane is present in the base aviation formulation at a concentration of about 2.8%. In some embodiments, the isobutane is present in the base aviation formulation at a concentration of about 2.9%.

In some embodiments, the isobutane is present in the base aviation formulation at a concentration of about 3%. In some embodiments, the isobutane is present in the base aviation formulation at a concentration of about 3.1%. In some embodiments, the isobutane is present in the base aviation formulation at a concentration of about 3.2%. In some embodiments, the isobutane is present in the base aviation formulation at a concentration of about 3.3%. In some embodiments, the isobutane is present in the base aviation formulation at a concentration of about 3.4%. In some embodiments, the isobutane is present in the base aviation formulation at a concentration of about 3.5%. In some embodiments, the isobutane is present in the base aviation formulation at a concentration of about 3.6%. In some embodiments, the isobutane is present in the base aviation formulation at a concentration of about 3.7%. In some embodiments, the isobutane is present in the base aviation formulation at a concentration of about 3.8%. In some embodiments, the isobutane is present in the base aviation formulation at a concentration of about 3.9%.

In some embodiments, the isobutane is present in the base aviation formulation at a concentration of about 4%. In some embodiments, the isobutane is present in the base aviation formulation at a concentration of about 4.1%. In some embodiments, the isobutane is present in the base aviation formulation at a concentration of about 4.2%. In some embodiments, the isobutane is present in the base aviation formulation at a concentration of about 4.3%. In some embodiments, the isobutane is present in the base aviation formulation at a concentration of about 4.4%. In some embodiments, the isobutane is present in the base aviation formulation at a concentration of about 4.5%. In some embodiments, the isobutane is present in the base aviation formulation at a concentration of about 4.6%. In some embodiments, the isobutane is present in the base aviation formulation at a concentration of about 4.7%. In some embodiments, the isobutane is present in the base aviation formulation at a concentration of about 4.8%. In some embodiments, the isobutane is present in the base aviation formulation at a concentration of about 4.9%.

In another aspect, a formulation is provided comprising the base aviation gasoline formulation and further comprises one or more additives. The formulations herein can include one additive or multiple additives.

The additive(s) may be combined with the base aviation fuel formulation, or with any components of the base aviation fuel formulation, in any order to result in the formulation. In certain aspects, when additive(s) are combined with the base aviation gasoline formulation, the resultant formulation is considered to be a finished aviation gasoline formulation.

In certain aspects, the additive is selected from the group consisting of m-toluidine, methylcyclopentadienyl manganese tricarbonyl (MMT), aniline, ethyl tert-butyl ether (ETBE), a corrosion inhibitor, a lubricity additive, one or more alcohols, and any combination thereof. In various embodiments, the additive comprises a corrosion inhibitor. In some embodiments, the corrosion inhibitor is selected from the group consisting of DCI-4A, DCI-6A, HITEC 580, NALCO 5403, NALCO 5405, PRI-19, UNICOR J, SPEC-AID 8Q22, TOLAD 351, TOLAD 4410, NALCO EC5407A, and any combination thereof. In other embodiments, the additive comprises a lubricity additive. In some embodiments, the lubricity additive is selected from the group consisting of Nalco5407A, Lubrizol, Infinium, Innospec, Afton MCC, and any combination thereof.

In another aspect, the additive comprises one or more alcohols. In some embodiments, the one or more alcohols are selected from the group consisting of ethanol, propanol, isopropanol, n-butanol, isobutanol, and any combination thereof. Without being bound to any theory, the alcohols may be combined with the base aviation gasoline formulation, which optionally comprises another additive, in order to address cold flow properties.

Concentrations of the one or more additives described herein refer to each additive individually in relation to the total volume of the formulation or to the total volume of the finished aviation gasoline formulation. In certain aspects, the additive is present in the formulation at a concentration between about 0.001% to about 5%. In some embodiments, the additive is present in the formulation at a concentration between about 0.01% to about 5%. In some embodiments, the additive is present in the formulation at a concentration between about 0.1% to about 5%. In some embodiments, the additive is present in the formulation at a concentration between about 1% to about 5%. In some embodiments, the additive is present in the formulation at a concentration between about 1% to about 5%. In some embodiments, the additive is present in the formulation at a concentration between about 2% to about 4%.

In some embodiments, the additive is present in the formulation at a concentration of about 2%. In some embodiments, the additive is present in the formulation at a concentration of about 2.1%. In some embodiments, the additive is present in the formulation at a concentration of about 2.2%. In some embodiments, the additive is present in the formulation at a concentration of about 2.3%. In some embodiments, the additive is present in the formulation at a concentration of about 2.4%. In some embodiments, the additive is present in the formulation at a concentration of about 2.5%. In some embodiments, the additive is present in the formulation at a concentration of about 2.6%. In some embodiments, the additive is present in the formulation at a concentration of about 2.7%. In some embodiments, the additive is present in the formulation at a concentration of about 2.8%. In some embodiments, the additive is present in the formulation at a concentration of about 2.9%.

In some embodiments, the additive is present in the formulation at a concentration of about 3%. In some embodiments, the additive is present in the formulation at a concentration of about 3.1%. In some embodiments, the additive is present in the formulation at a concentration of about 3.2%. In some embodiments, the additive is present in the formulation at a concentration of about 3.3%. In some embodiments, the additive is present in the formulation at a concentration of about 3.4%. In some embodiments, the additive is present in the formulation at a concentration of about 3.5%. In some embodiments, the additive is present in the formulation at a concentration of about 3.6%. In some embodiments, the additive is present in the formulation at a concentration of about 3.7%. In some embodiments, the additive is present in the formulation at a concentration of about 3.8%. In some embodiments, the additive is present in the formulation at a concentration of about 3.9%.

In some embodiments, the additive is present in the formulation at a concentration of about 4%. In some embodiments, the additive is present in the formulation at a concentration of about 4.1%. In some embodiments, the additive is present in the formulation at a concentration of about 4.2%. In some embodiments, the additive is present in the formulation at a concentration of about 4.3%. In some embodiments, the additive is present in the formulation at a concentration of about 4.4%. In some embodiments, the additive is present in the formulation at a concentration of about 4.5%. In some embodiments, the additive is present in the formulation at a concentration of about 4.6%. In some embodiments, the additive is present in the formulation at a concentration of about 4.7%. In some embodiments, the additive is present in the formulation at a concentration of about 4.8%. In some embodiments, the additive is present in the formulation at a concentration of about 4.9%.

In certain embodiments, addition of the one or more additives provides a Motor Octane Number (MON) rating to a desired MON level. Methods of determining MON rating are well known in the art and typically utilize an engine speed of 900 rpm. In some instances, the desired MON level is about 99.6. However, in other embodiments, the desired MON level is less than 99.6 but in compliance with an ASTM D910-like specification (i.e. Specification Relief). The ASTM 910 is an existing specification for leaded aviation gasolines and is well known to the skilled artisan. Further, it is contemplated that a "new" ASTM specification standard without the use of lead will be identified (herein referred to as an ASTM D910-like specification) and that the disclosed formulations will meet the ASTM D910-like specification.

In some aspects, the base aviation gasoline formulation is substantially free of hydrocarbon-based aromatics. As used herein, aromatics refers to hydrocarbon-based aromatics. In some aspects, the formulation is substantially free of hydrocarbon-based aromatics. As used herein, the term "substantially free" refers to zero or nearly no detectable amount of a material, quantity, or item. For example, the amount can be less than 2 percent, less than 0.5 percent, or less than 0.1 percent of the material, quantity, or item. In some embodiments, the base aviation gasoline formulation does not comprise hydrocarbon-based aromatics. In some embodiments, the formulation does not comprise hydrocarbon-based aromatics.

In another aspect of the present disclosure, a finished aviation gasoline formulation is provided, wherein the finished aviation gasoline formulation comprises i) dimethylbutane at a concentration between about 10% to about 40%; ii) trimethyl pentane at a concentration between about 50% to about 90%; iii) isobutane at a concentration between about 1% to about 5%, and iv) two additives, wherein the two additives comprise a first additive and a second additive. The previously described embodiments of the base aviation gasoline formulation, and to the formulation comprising the base aviation gasoline formulation further comprising one or more additives, are also applicable to the finished aviation gasoline formulation described herein.

The finished aviation gasoline formulation comprises two additives, wherein the two additives comprise a first additive and a second additive. The first additive may be present in the finished aviation gasoline formulation at a concentration between about 0.001% to about 5%, relative to the total volume of the finished aviation gasoline formulation. The second additive may be present in the finished aviation gasoline formulation at a concentration between about 0.001% to about 5%, relative to the total volume of the finished aviation gasoline formulation. Any concentration of additive as previously described for the formulation of base aviation gasoline formulation further comprising one or more additives are also applicable to the finished aviation gasoline formulation.

EXAMPLE 1

Preparation of Formulations

In one exemplary embodiment, the base aviation gasoline formulation comprises the following: dimethylbutane at 25%; trimethyl pentane at 71.5%; and isobutane at 3.5%. All percentages listed refer to volume percentages, unless otherwise noted.

The base aviation gasoline formulation can be combined with one or more additives to produce a finished aviation gasoline formulation that meet current ASTM D910 specifications. For example, a finished aviation gasoline formulation can comprise i) the base aviation gasoline formulation comprising dimethylbutane at 25%; trimethyl pentane at 71.5%; and isobutane at 3.5% and ii) m-toluidine at 2.0%. The percentage of components for this exemplary finished aviation gasoline formulation is thus as shown in Table 1:

TABLE 1

| Component | Percentage of Component in Finished Aviation Gasoline Product | Percentage of Ingredient in Base Aviation Gasoline Formulation |
|---|---|---|
| Base Aviation Gasoline Formulation | 98% | 25% dimethylbutane<br>71.5% trimethyl pentane<br>3.5% isobutane |
| Additive (m-toluidine) | 2% | |

In another example, a finished aviation gasoline formulation can comprise i) the base aviation gasoline formulation comprising dimethylbutane at 25%; trimethyl pentane at 71.5%; and isobutane at 3.5%, ii) m-toluidine at 2.0%, and iii) isobutanol at 3.0%. The percentage of components for this exemplary finished aviation gasoline product is as shown in Table 2:

TABLE 2

| Component | Percentage of Component in Finished Aviation Gasoline Product | Percentage of Ingredient in Base Aviation Gasoline Formulation |
|---|---|---|
| Base Aviation Gasoline Formulation | 95% | 25% dimethylbutane<br>71.5% trimethyl pentane<br>3.5% isobutane |
| Additive (m-toluidine) | 2% | |
| Additive (isobutanol) | 3% | |

EXAMPLE 2

Evaluation of Exemplary Formulations

In this example, various formulations were evaluated for distillation characteristics and other properties according to known ASTM evaluation methods. Five different formulations were evaluated and the results are presented in Table 3 and Table 4 below. All percentages listed refer to volume percentages, unless otherwise noted.

TABLE 3

| | GD170738 Second Lab Blend | GD170738 First Lab Blend | GD161554 | GD170738 | GD170738 60-40 |
|---|---|---|---|---|---|
| 2,2-Dimethylbutane | | | | | 15 |
| 2,3-Dimethylbutane | 25.0 | 25.0 | 25.0 | 25.0 | 10 |
| Isopentane | 71.5 | 71.5 | 71.5 | 71.5 | 71.5 |
| Toluene | | | | | |
| Trimethyl Pentane | | | | | |
| Isobutane | 3.5 | 3.5 | 3.5 | 3.5 | 3.5 |
| Base fuel | 100.0 | 100.0 | 100.0 | 100.0 | 100.0 |
| m-Toluidine | 2.00% | 2.00% | 0% | 2.00% | 2.00% |

TABLE 4

| Test | Method | Unit | Specifications MIN | Specifications MAX | GD170738 Second Lab Blend 2% m-Toluidine | GD170738 First Lab Blend 2% m-Toluidine | GD161554 0% m-Toluidine | GD170738 ChemCAD Simulation 2% m-Toluidine | GD170738 60-40 ChemCAD Simulation 2% m-Toluidine |
|---|---|---|---|---|---|---|---|---|---|
| Distillation, % Evap-IBP | ASTM D86 | ° C. | | | 41.4 | 41.7 | 39.5 | 59.7 | 56.9 |
| 5% | | ° C. | | | | 67.8 | 66.8 | 69.0 | 65.8 |
| 10% | | ° C. | | 75 | 75.2 | 75.6 | 74.8 | 75.6 | 72.4 |
| 20% | | ° C. | | | | 82.2 | 81.6 | 82.8 | 80.5 |
| 30% | | ° C. | | | | 86.0 | 84.9 | 86.6 | 85.3 |
| 40% | | ° C. | 75 | | 88.5 | 89.1 | 87.9 | 89.7 | 89.4 |
| 50% | | ° C. | | 105 | 91.5 | 92.4 | 90.9 | 92.8 | 93.2 |
| 60% | | ° C. | | | | 95.3 | 93.7 | 95.8 | 96.5 |
| 70% | | ° C. | | | | 97.6 | 95.9 | 98.5 | 99.2 |
| 80% | | ° C. | | | | 99.6 | 97.2 | 100.7 | 101.1 |
| 90% | | ° C. | | 135 | 100.3 | 101.4 | 97.7 | 102.5 | 102.6 |

TABLE 4-continued

| Test | Method | Unit | Specifications MIN | Specifications MAX | GD170738 Second Lab Blend 2% m-Toluidine | GD170738 First Lab Blend 2% m-Toluidine | GD161554 0% m-Toluidine | GD170738 ChemCAD Simulation 2% m-Toluidine | GD170738 60-40 ChemCAD Simulation 2% m-Toluidine |
|---|---|---|---|---|---|---|---|---|---|
| 95% | | ° C. | | | | 102.8 | 97.8 | 103.7 | 103.7 |
| Distillation-EP | | ° C. | | 170 | 178.2 | 132.2 | 103.0 | 109.4 | 109.4 |
| Recovery | | vol % | 97.0 | | 97.1 | 96.7 | 97.8 | | |
| Residue | | vol % | | 1.5 | 1.1 | 2.1 | 0.9 | | |
| Loss | | vol % | | 1.5 | 1 | 1.2 | 1.3 | | |
| T10 + T50 | ASTM D86 | ° C. | 135.0 | | 166.7 | 168.0 | | 168.4 | |
| Reid Vapor Pressure, E, (ASTM) | ASTM D5191 | kPa | 38 | 49 | 45.4 | 43.55 | 43.55 | | |
| Freeze Point (Dixie) | ASTM D2386 | ° C. | | −58.0 | | | | | |
| Freeze Point (Haltermann) | ASTM D2386 | ° C. | | −58 | | | | | |
| Motor Octane Number | ASTM D2700 | | | | 100.4 | 100.4 | 97.4 | | |
| Supercharge | ASTM D910 | | | | 132.5 | | | | |

EXAMPLE 3

Analysis of Exemplary Formulations

In this example, an exemplary gasoline formulations was analyzed for compliance with the requirements for Grade 100LL detailed in Table 1 of ASTM D910-17a, entitled "Standard Specification for Leaded Aviation Gasolines." The results of the analysis are presented in Table 5 and Table 6. All percentages listed refer to volume percentages, unless otherwise noted.

TABLE 5

| Test | Property | Subject Sample | Grade 100LL |
|---|---|---|---|
| D3338 | Net heat of combustion, MJ/kg | 44.460 | 43.5 MIN |
| D2700 | Knock value, lean mixture | | |
| | Motor Octane Number | 100.4 | 99.6 MIN |
| | Aviation Lean Rating | 102.1 | 100.0 MIN |
| D909 | Knock value, rich mixture | | |
| | Performance number | 135.2 | 130.0 MIN |
| D2622 | Sulfur, mass percent | <0.0001 | 0.05 MAX |
| D5059(c) | Tetraethyl lead, g Pb/L | <0.005 | 0.28 MIN, 0.56 MAX |
| D2392 | Color | Any | Blue |

TABLE 6

| Test | Property | Subject Sample | All Grades |
|---|---|---|---|
| D5191 | Vapor pressure, 38° C., kPa | 45.4 | 38.0 MIN, 49.0 MAX |
| D4052 | Density at 15° C., kg/m$^3$ | 691.0 | REPORT |
| D86 | Distillation, ° C. | | |
| | Initial boiling point | 41.4 | REPORT |
| | Fuel Evaporated | | |
| | 10 volume percent at ° C. | 75.2 | 75 MAX |
| | 40 volume percent at ° C. | 88.5 | 75 MIN |
| | 50 volume percent at ° C. | 91.5 | 105 MAX |
| | 90 volume percent at ° C. | 100.3 | 135 MAX |
| | Final boiling point | 178.2 | 170 MAX |
| | Sum of 10% + 50% evaporated temperatures | 166.7 | 135 MIN |
| | Recovery volume percent | 97.9 | 97 MIN |
| | Residue volume percent | 1.1 | 1.5 MAX |

TABLE 6-continued

| Test | Property | Subject Sample | All Grades |
|---|---|---|---|
| | Loss volume percent | 1.0 | 1.5 MAX |
| D2386 | Freezing point, ° C. | nd | −58 MAX |
| D130 | Copper strip, 2 h at 100° C. | 3a | No. 1 MAX |
| D873 | Oxidation stability, mg/100 mL (5 h aging) | | |
| | Potential gum | 3 | 6 MAX |
| | Lead precipitate | <0.1 | 3 MAX |
| D1094 | Water reaction | | |
| | Volume change, mL | 0.0 | +/−2 MAX |
| D2624 | Electrical conductivity, pSm | 3 | 450 MAX |

Regarding test D2386, behavior of the sample was atypical compared to normal hydrocarbon fuels. Analyst observations of the subject sample are summarized below. The temperature when the particles disappear is recorded as the observed freezing point.

On cooling:

| | |
|---|---|
| Haze consistent throughout the sample | −19 |
| Sample removed from cooling bath | −19 |

On warming:

| | |
|---|---|
| Haze disappears | −17 |

EXAMPLE 4

Analysis of Co-Solvent Additives

In various embodiments, a co-solvent additive can be included in the finished aviation gasoline formulation in order to address cold flow properties of the formulation. For example, a co-solvent additive such as an alcohol can be added in this regard.

This example provides a protocol for evaluation of various alcohols as co-solvents. In particular, alcohols can be added to the base aviation gasoline formulation (e.g., at 3% vol) and evaluated for i) MON, ii) T10, and iii) freezing point. The resultant analysis can provide the best alcohol or alcohols for achieving desirable cold flow properties of the formulation.

What is claimed is:

1. A finished aviation gasoline formulation comprising a) a base aviation gasoline formation comprising:

i) dimethylbutane at a concentration between about 10% to about 40%;

ii) trimethyl pentane at a concentration between about 50% to about 90%;

iii) isobutane at a concentration between about 1% to about 5%, and b) a first additive selected from the group consisting of m-toluidine, aniline, or a combination of both, wherein the first additive is present in the finished gasoline formulation at a concentration between about 0.001% to about 5%.

2. The finished aviation gasoline formulation of claim 1, wherein the finished aviation gasoline formulation further comprises c) a second additive.

3. The finished aviation gasoline formulation of claim 2, wherein the second additive is selected from the group consisting of methylcyclopentadienyl manganese tricarbonyl (MMT), ethyl tert-butyl ether (ETBE), a corrosion inhibitor, a lubricity additive, one or more alcohols, and any combination thereof.

4. The finished aviation gasoline formulation of claim 2, wherein the second additive comprises one or more alcohols.

5. The finished aviation gasoline formulation of claim 2, wherein the second additive is selected from the group consisting of ethanol, propanol, isopropanol, n-butanol, isobutanol, and any combination thereof.

6. The finished aviation gasoline formulation of claim 2, wherein the second additive is isobutanol.

7. The finished aviation gasoline formulation of claim 2, wherein the first additive is m-toluidine and the second additive is isobutanol.

8. The finished aviation gasoline formulation of claim 2, wherein addition of the first additive and the second additive provides a MON rating to a desired MON level, wherein the desired MON level is about 99.6.

9. The finished aviation gasoline formulation of claim 1, wherein the formulation is substantially free of hydrocarbon-based aromatics.

10. The finished aviation gasoline formulation of claim 1, wherein the first additive is m-toluidine.

11. The finished aviation gasoline formulation of claim 1, wherein the first additive is aniline.

12. The finished aviation gasoline formulation of claim 1, wherein the first additive is aniline and the second additive is isobutanol.

13. The finished aviation gasoline formulation of claim 6, wherein the isobutanol is present in the finished gasoline formulation at a concentration between about 0.001% to about 5%.

14. The finished aviation gasoline formulation of claim 6, wherein the isobutanol is present in the finished gasoline formulation at a concentration between about 0.001% to about 4%.

15. The finished aviation gasoline formulation of claim 1, wherein the dimethylbutane is present in the base aviation gasoline formulation at a concentration between about 20% to about 30%.

16. The finished aviation gasoline formulation of claim 1, wherein trimethyl pentane is present in the base aviation gasoline formulation at a concentration between about 60% to about 80%.

17. The finished aviation gasoline formulation of claim 1, wherein isobutane is present in the base aviation gasoline formulation at a concentration between about 2% to about 5%.

18. The finished aviation gasoline formulation of claim 1, wherein the first additive is present in the finished gasoline formulation at a concentration between about 1% to about 5%.

19. The finished aviation gasoline formulation of claim 2, wherein the second additive is present in the finished gasoline formulation at a concentration between about 2% to about 4%.

20. A finished aviation gasoline formulation comprising a) a base aviation gasoline formation comprising:

i) dimethylbutane at a concentration of about 25% of the base aviation gasoline formation;

ii) trimethyl pentane at a concentration of about 71.5% of the base aviation gasoline formation;

iii) isobutane at a concentration of about 3.5% of the base aviation gasoline formation, and b) a first additive, wherein the first additive is selected from the group consisting of m-toluidine, aniline, or a combination of both, and wherein the first additive is present in the finished gasoline formulation at a concentration of about 2%, and c) a second additive, wherein the second additive is isobutanol, and wherein the isobutanol is present in the finished gasoline formulation at a concentration of about 3%.

* * * * *